US005884822A

United States Patent [19]

Migliorini

[11] Patent Number: 5,884,822

[45] Date of Patent: Mar. 23, 1999

[54] METHOD AND APPARATUS FOR PICKING UP AND MOVING TUBULAR ARTICLES

[75] Inventor: Pier Lorenzo Migliorini, Terranuova Bracciolini, Italy

[73] Assignee: Matec S.R.L., Scandicci, Italy

[21] Appl. No.: 889,633

[22] Filed: Jul. 8, 1997

[30] Foreign Application Priority Data

Jul. 9, 1996 [IT] Italy ..... FI96A0163

[51] Int. Cl.[6] ..... D06C 5/00

[52] U.S. Cl. ..... 223/1; 223/75; 223/39

[58] Field of Search ..... 223/75, 77, 39, 223/1

[56] References Cited

U.S. PATENT DOCUMENTS 5,238,116 8/1993 Santicchi ..... 209/33
5,456,392 10/1995 Majors ..... 223/112
5,505,350 4/1996 Migliorini ..... 223/75
5,513,782 5/1996 Rosso ..... 223/1
5,769,286 6/1998 Conti ..... 223/75

*Primary Examiner*—Bibhu Mohanty
*Attorney, Agent, or Firm*—McGlew and Tuttle, P.C.

[57] ABSTRACT

Apparatus for picking up and moving tubular articles such as knitted stockings, comprising:—pneumatic means for picking up at least one article from a heap or container;—pneumatic means for moving the thus picked-up article(s) ;—means positioned in a first stopping station for holding the most forward portion of at least one article;—optical means for detecting the article portion which results further away from said first stopping station and associated buffer means to operate the retention thereof at a second station located intermediate between the station for picking up the articles and the stopping station;—mechanical means for holding the article in correspondence of a portion thereof at a preset distance from the end thereof being retained in said second station;—means for assessing the thickness of the article end being retained in said second station. (FIG. 1A).

26 Claims, 17 Drawing Sheets

METHOD AND APPARATUS FOR PICKING UP AND MOVING TUBULAR ARTICLES

SPECIFICATION

The present invention refers to a method and apparatus for picking up and moving tubular articles such as knitted stockings.

In the textile industry and, in particular, in the manufacturing of pantyhose articles, a long known problem is the picking up of tubular articles from a station in which the same articles are accumulated in bulk and the moving thereof to a station for the loading of the shapes of a pantyhose-sewing machine, so that each article will result with one of the respective ends oriented in a preset direction.

The main object of the present invention is to provide an operating method and apparatus which allow the above mentioned problem to be solved in a very simple, cost-effective and reliable way.

This result has been achieved, according to the invention, by providing an operating method and apparatus having the characteristics disclosed in the claims 1 and 6. Further characteristics being set forth in the dependent claims.

The advantages deriving from the present invention lie essentially in that it is possible to operate, also in a fully automated way and with the maximum operational accuracy, the removal of articles from a heap or a container wherein the articles are accumulated in bulk, and to individually orient them so that each of them will present the respective ends disposed in a preset direction allowing them to be automatically supplied to a pantyhose-sewing machine, located downstream of the apparatus, at an operational speed higher than that allowed by the conventional manual supply methods and at a much reduced cost; that an apparatus according to the invention is relatively simple to make, cost-effective and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense, wherein.

Figure 10:
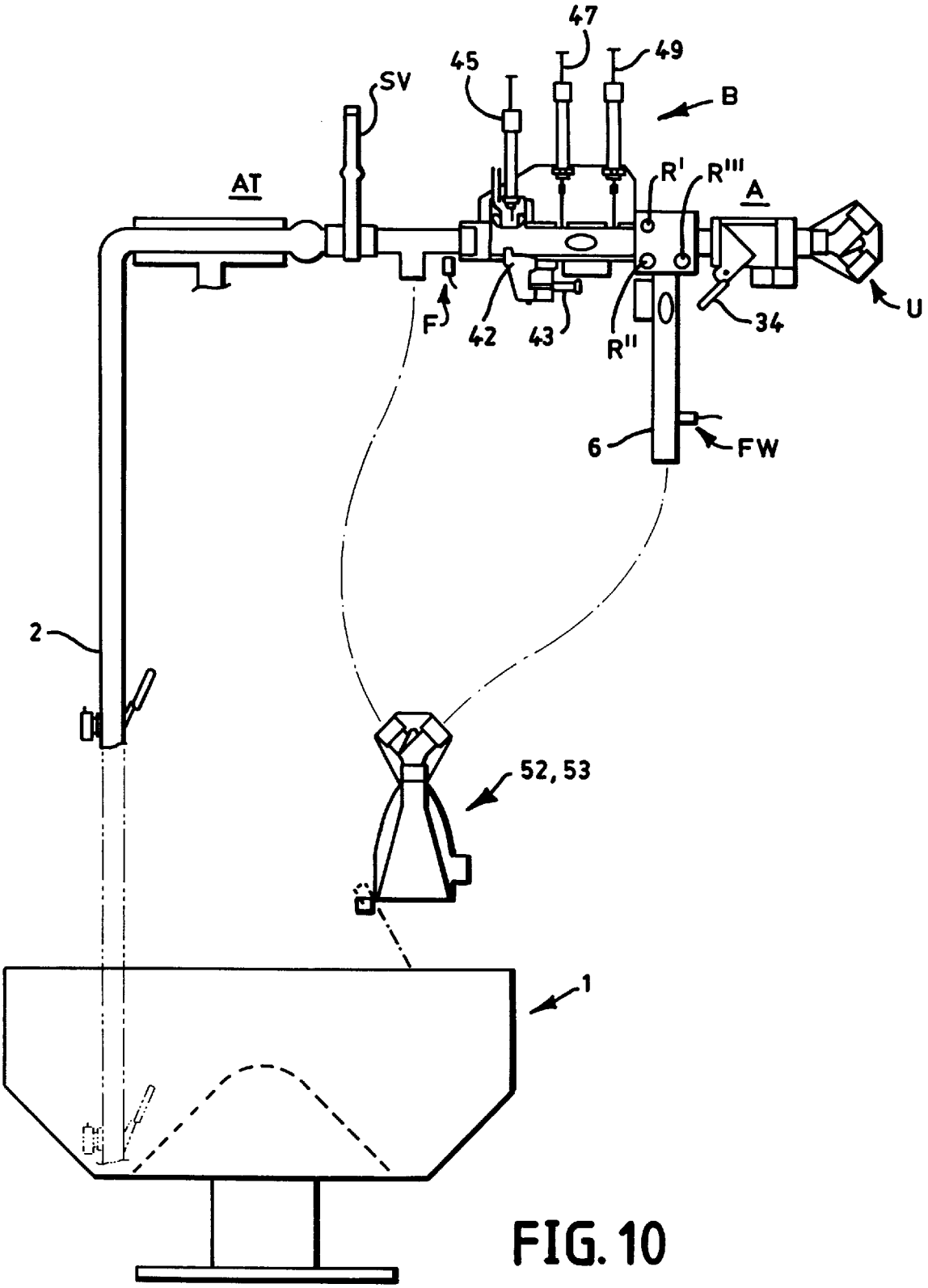

FIG. 10 is a schematic representation of a further embodiment of the apparatus according to the invention. Reduced to its basic structure, and reference being made to the figures of the attached drawings, a method for automatically picking up a tubular article of flexible and elastic material, such as a knitted stocking, from a heap or container (M) in which a plurality of articles are accumulated in bulk, the article having two end portions of equal or different thickness, and for orienting said ends in a preset direction, according to the invention, comprises the following operating steps:

picking up at least one article (1) from the heap or container (M);

moving the thus removed article(s) (1) towards and as far as a first stop station (A) downstream of the removal station;

holding, in said stop station, the most forward portion of at least one article (1);

moving each article (1) in a direction opposite to the one of approach to the stop station (A), so as to achieve the corresponding stretching of the articles held therein and the moving away of the free ones, that is, not held therein;

detecting the article (1) portion which results further away from said first stopping station (A) and operate the retention thereof at a second station (B) in a position intermediate between the station for the removal of the articles and the first stopping station (A);

releasing the end of each article being held in the first stopping station (A);

moving each article in a direction opposite to that of the preceding stretching so as to move away and unload the articles whose end is free, that is, not retained, at said second station (B) and thus ensuring that the subsequent steps will affect one article (1) only;

holding, in case the ends of the articles (1) under treatment have different thickness, a portion of said single article (1) at a preset distance from the end thereof which has been retained in said second station (B);

releasing also the article end being held at said second station (B);

assessing, should the ends of the articles be of different thickness, the thickness of the article (1) end held in said second station (B); and moving the thus treated article (1) towards and as far as a third unloading station (U), after a reversal of its orientation in case its thicker end is detected in said second station (B).

Advantageously, according to the invention, one or more of the above said steps for picking up, moving and stretching the articles are obtained by corresponding pneumatic suctions performed in a direction according to that of said moving and/or stretching steps.

Provision is also made, advantageously, for performing the said detection step, for detecting the article's free end at the second station (B), by optical means.

Also advantageously, the said first and third stations (A, U) are provided at corresponding fixed and preset positions, while the location of said second stopping station (B) is made to vary according to the instantaneous configuration taken up by the articles (1). However, according to a modified embodiment, each of said stations (A, B, U) may be either fixed or movable.

Advantageously, the assessment of the thickness of the article end held in said second station (B) is operated by causing the article to pass through an opening or filter, of a width less than the maximum thickness of the same article, in a direction oriented from the second station (B) to the exit station (U), so as to intercept the article's thicker end in case the latter is held in the second station (B).

One or more of said operating steps may also be performed manually.

As far as the implementation of the above said method is concerned, according to a feasible embodiment of the invention, provision is made for an apparatus comprising in combination:

means for picking up at least one article (1) from a heap or container (M), with a tubular body (2) associated to a suction system and provided with a mouth (20) which can be positioned under control in correspondence of the heap (M), so as to act on any portion of at least one article (1);

mean for moving each of the thus removed articles with two coaxial tubular elements (3, 30) having facing ends and being joined by a tubular carriage (4) mounted for sliding on the walls of said elements (3, 30) and engaged to a relevant actuator (40) to allow same carriage to move along an axis substantially coincident with the one in common with the facing end portions of the tubular elements (3, 30): said tubular elements (3, 30) being engaged to pneumatic suction means acting on each of them;

means for stopping each article, at a first fixed station (A), inside at least one (30) of said elements (3, 30) with a perforated plate (31) located inside at least one said element and hinged at a fixed point to allow for its rotation under the control of a relevant actuator (32), between a first position for the interception or stopping of the picked-up articles and a second position for the free transit thereof;

means for holding a portion of at least one article (1) in correspondence of said station (A), with a rod-like body (33) engaged to an actuator (34) and whose free end is intended to act, under operating conditions, on the article (1), in cooperation either with the plate (31) disposed in intercepting position, or with the surface of an inner wall of the tubular element (30): said body (33) going through a guide hole (35) formed in the tubular element (30), and the relevant actuator (34) being fixed in correspondence of a wall of the same element (30); alternatively, the plate (31) may be driven into a translation, instead of a rotation motion;

means for detecting the article (1) free end further away from said stopping station (A), with a plurality of optical sensors (41) borne by said carriage (4) and lined up according to an axis substantially orthogonal to the axis of motion of the same carriage;

means for retaining, at a second station (B), the said end of the article (1) in the position detected by said optical means, by means of a plurality of laminae (42) each of which is associated to a corresponding sensor (41) and engaged to a respective actuator (43), each lamina (42) being hinged at a fixed point to allow for the rotation thereof, under the control of the respective sensor (41), by means of the corresponding actuator (41), and bringing the free end thereof in contact with the article (1) in order to retain it in cooperation with a buffer (44) positioned on the opposite side and engaged to a corresponding actuator (45), the said laminae (42) with the respective actuators (43), and the said buffer (44) with the respective actuator (45) being integral with the carriage (4);

means for advantageously detecting any presence of the thicker portion of the article in proximity of said second station (B), with a lamina (46) going through a corresponding slit of the carriage (4), orthogonally to the axis of motion of the latter and downstream of the optical means (41), and engaged to a corresponding actuator (47) to allow for the positioning, under control, of the respective free end (461) at a preset distance from the corresponding and opposite inner wall of the carriage (4): such distance being suitably chosen and adjustable so as to allow for the transit of the article (1) portions of smaller thicker and to retain those of greater thickness, the lamina (46) with the respective actuator (47) being integral with the carriage (4);

means, downstream of said lamina (46), with a second perforated plate (48) engaged to a corresponding actuator (49) in order to intercept, under control, a corresponding portion of the article (1);

means for possibly inverting the orientation of the article (1), with at least one tubular element (6) located downstream of the second station (B) and engaged to pneumatic suction means to allow for the movement of the article thereinside.

Advantageously, associated to the mouth (20) of said tube (2), is a nozzle (21) for blowing compressed air in correspondence of the region in which the articles are picked up from the heap (M) so as to detach from those already removed others possibly adhering thereto.

The said tube (2) is advantageously of telescopic type and driven into motion by at least one actuator (22). Advantageously associated to said lamina (46) is an optical sensor (460) whose function is to detect any presence of a portion of the article (1) held in the second station (B).

Also advantageously, said tube (2) is provided, in correspondence of its mouth (20), with a valve (23) able to controllably reducing the opening thereof so that, upon the article removal step, said opening be of minimum extent and thereby affecting the minimum number of articles and, upon the next step, the same opening be of maximum extent to allow for a fast transit of the article(s) through the tube (2) by virtue of the corresponding suction.

By way of non limitative example, reference being made to the figures of the attached drawings, the table below indicates the positions of the valves (V2, V3, V4, V5, V6) of the pneumatic system associated to the above described apparatus.

Figure 1A:
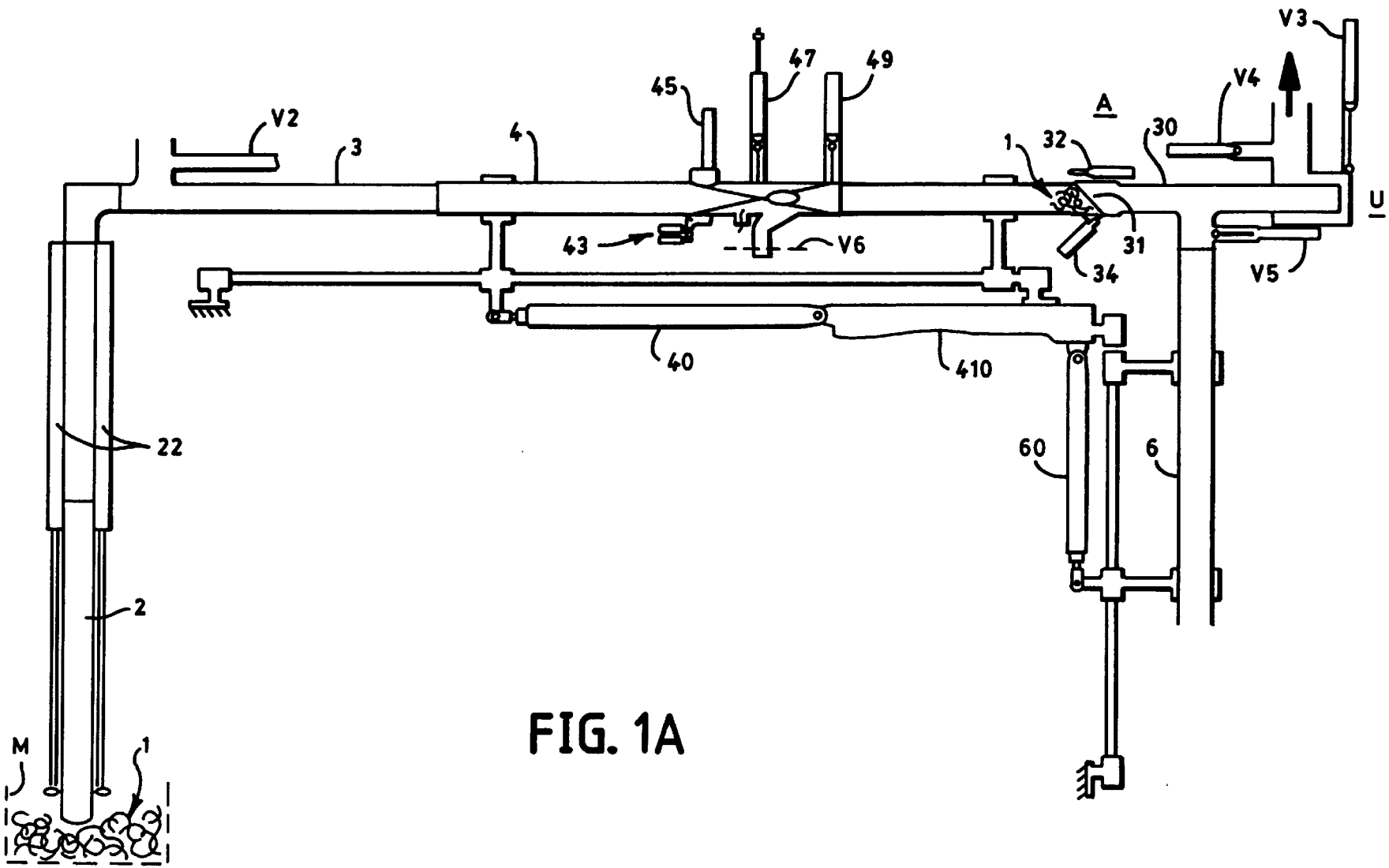
FIG. 1A is a view in longitudinal sectional showing an apparatus according to the invention upon the beginning of its work cycle.
Figure 1B:
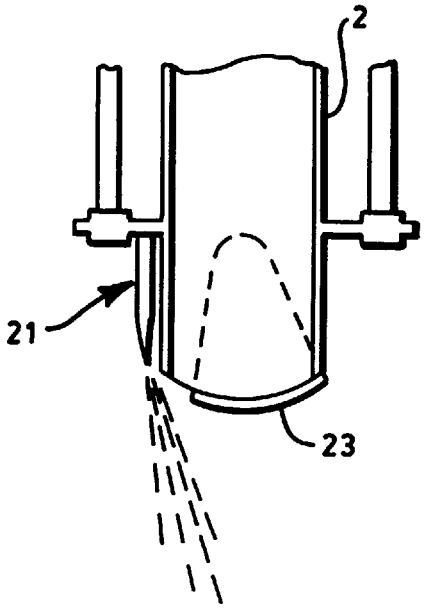
FIGS. 1B and 1C show a detail of the apparatus of FIG. 1A.
Figure 1C:
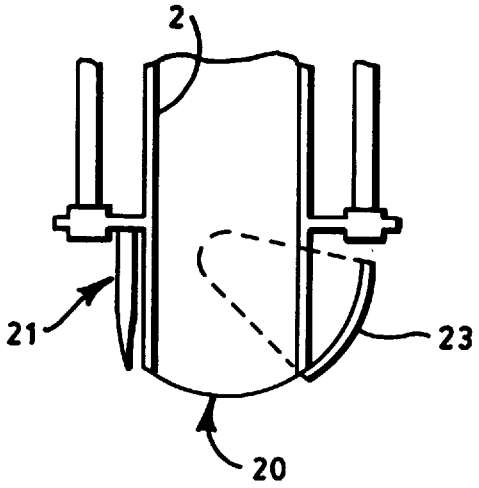
Figure 2B:
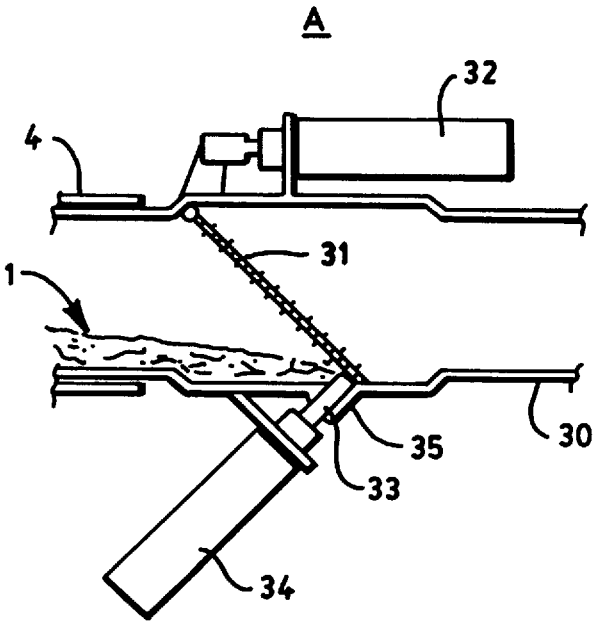
FIG. 2B shows a detail of the apparatus of FIG. 2A.
Figure 2A:
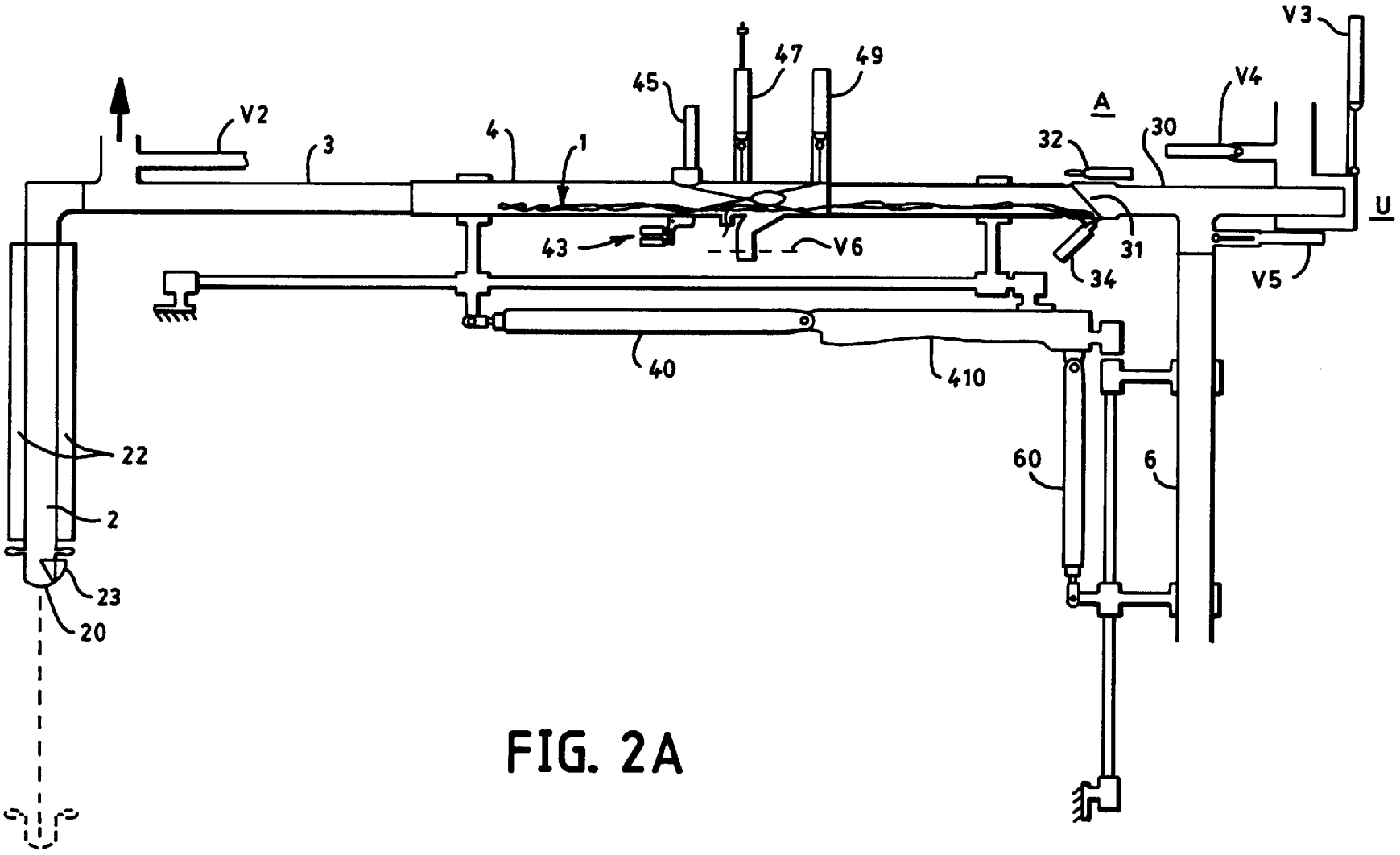
FIG. 2A shows the apparatus of FIG. 1A after at least one article ha been sucked out of the heap (M)
Figure 3A:
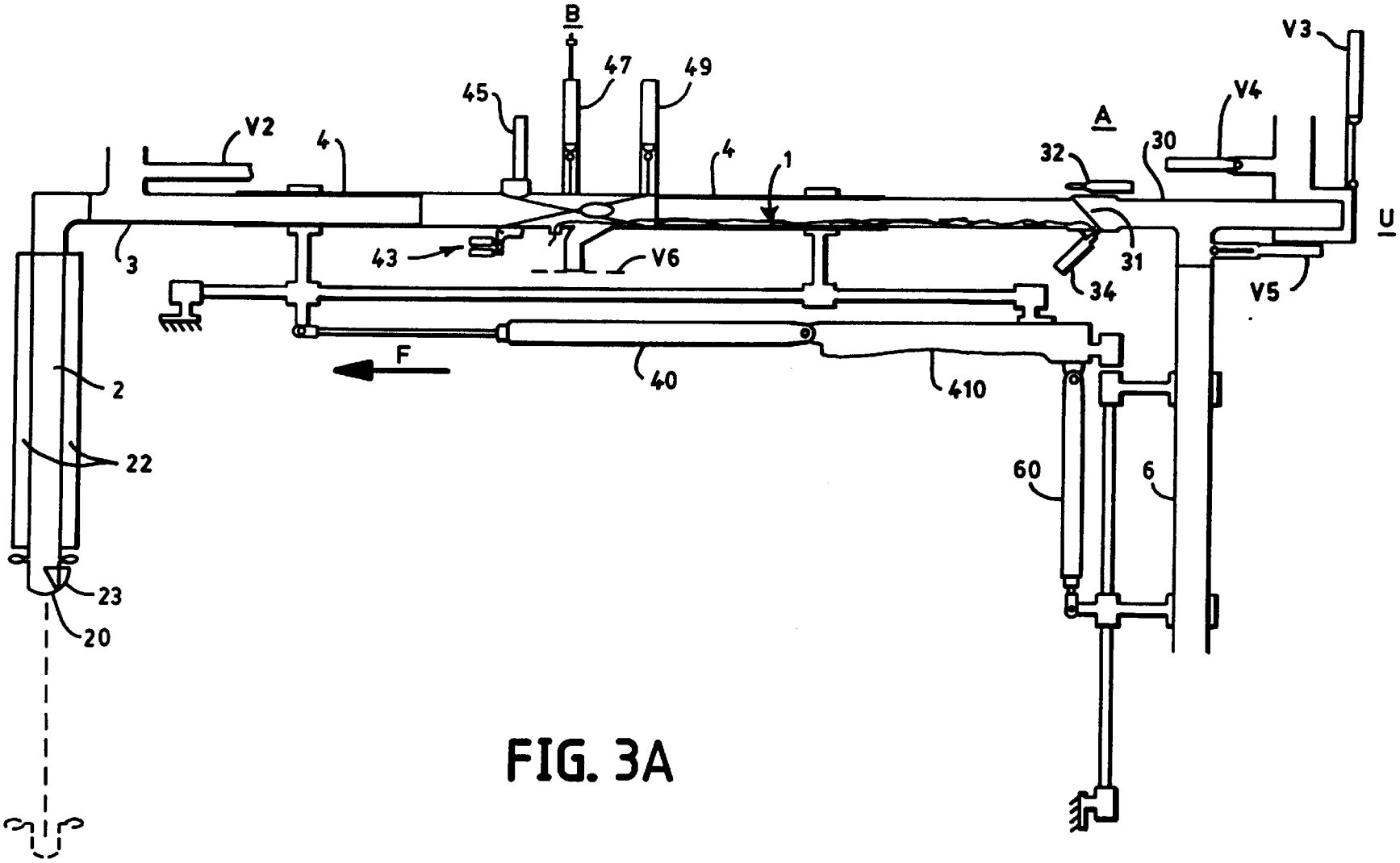
FIG. 3A and FIG. 3D show the apparatus of FIG. 1A upon an operating step, subsequent to the one of FIG. 2A.
Figure 5A:
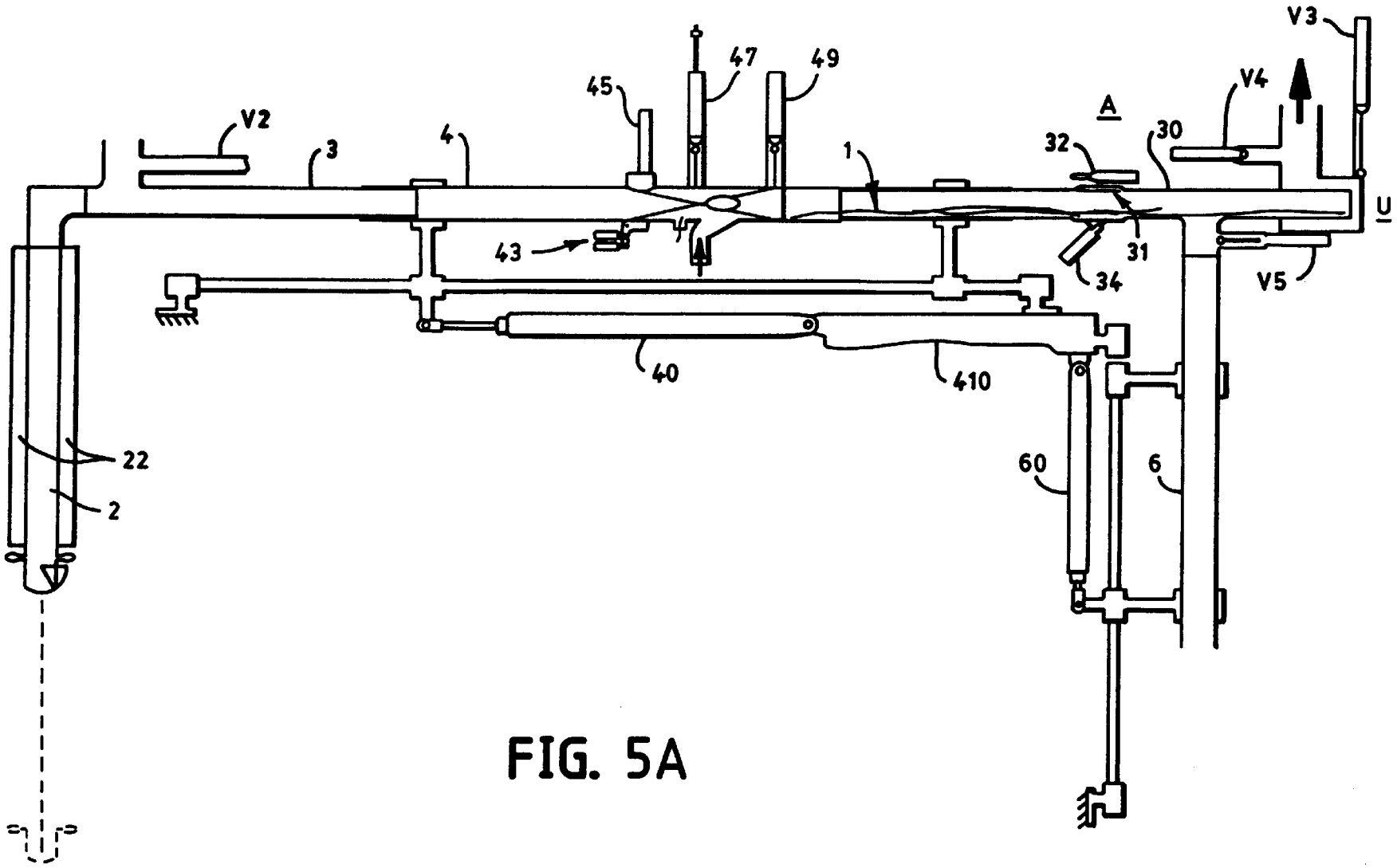
FIG. 5A shows the apparatus of FIG. 1A upon a possible operating step, subsequent to the one of FIG. 4A.
Figure 5B:
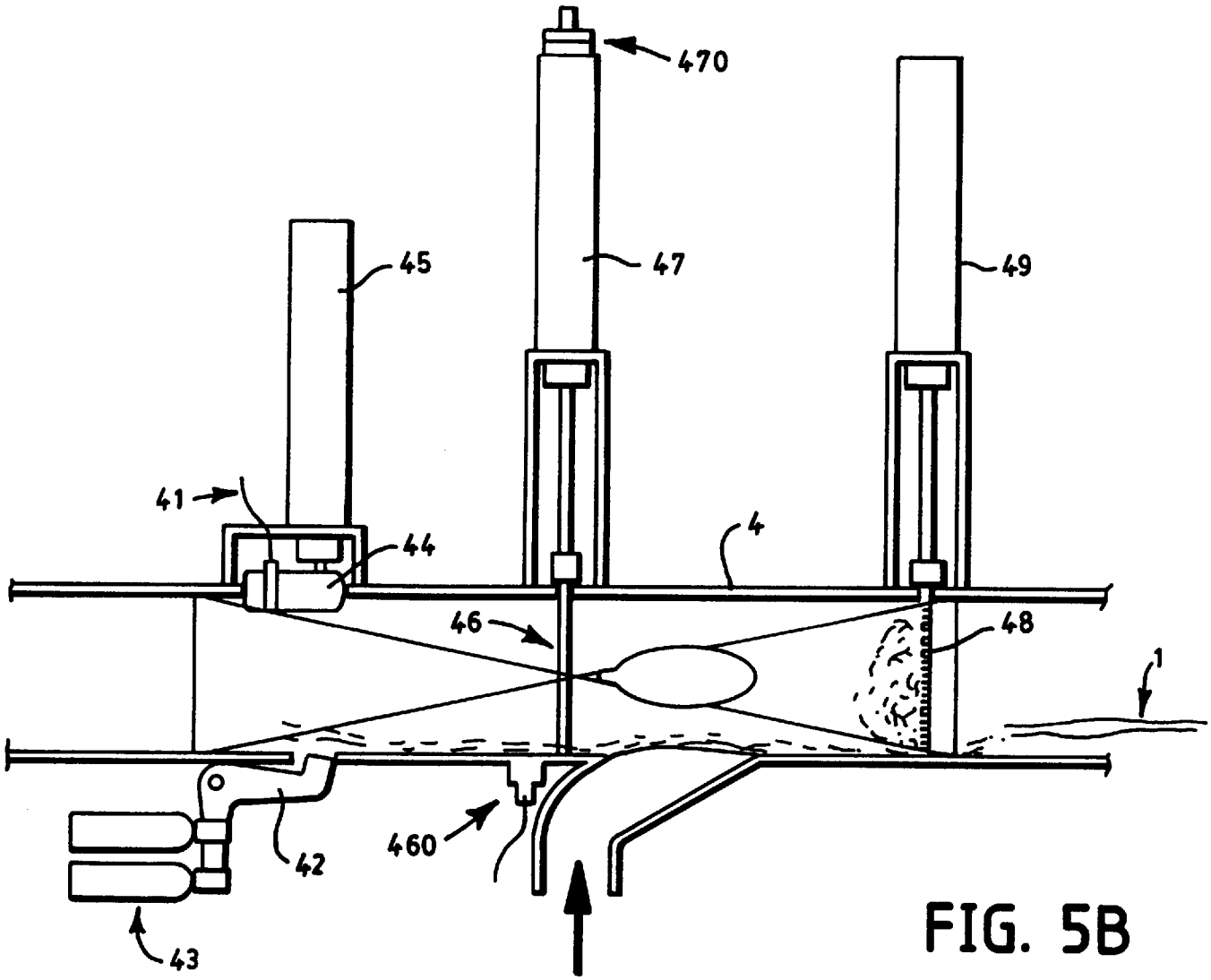
FIG. 5B shows a detail of the apparatus of FIG. 5A.
Figure 6A:
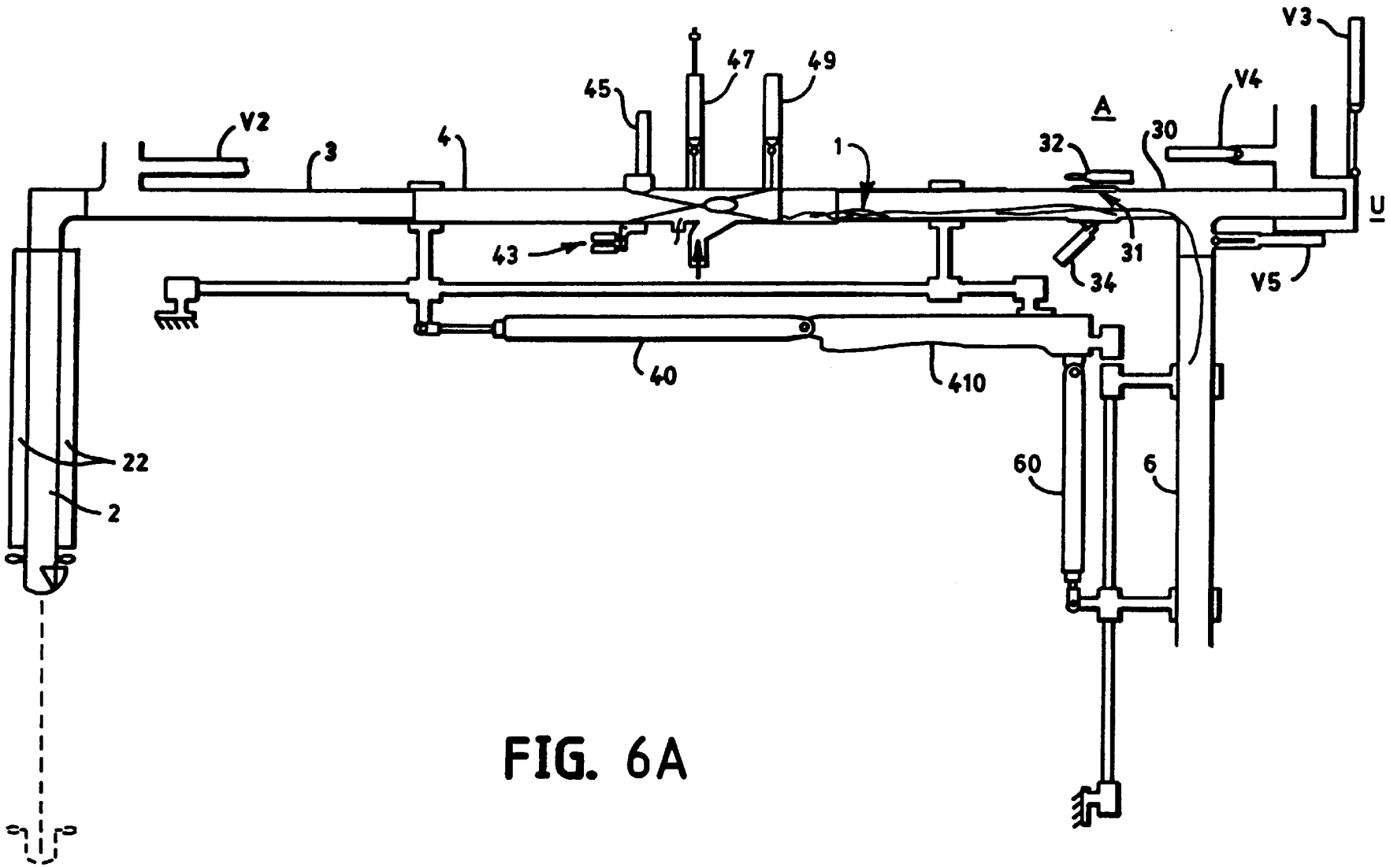
FIG. 6A shows the apparatus of FIG. 1A upon an operating step alternative to the one of FIG. 5A.
Figure 6B:
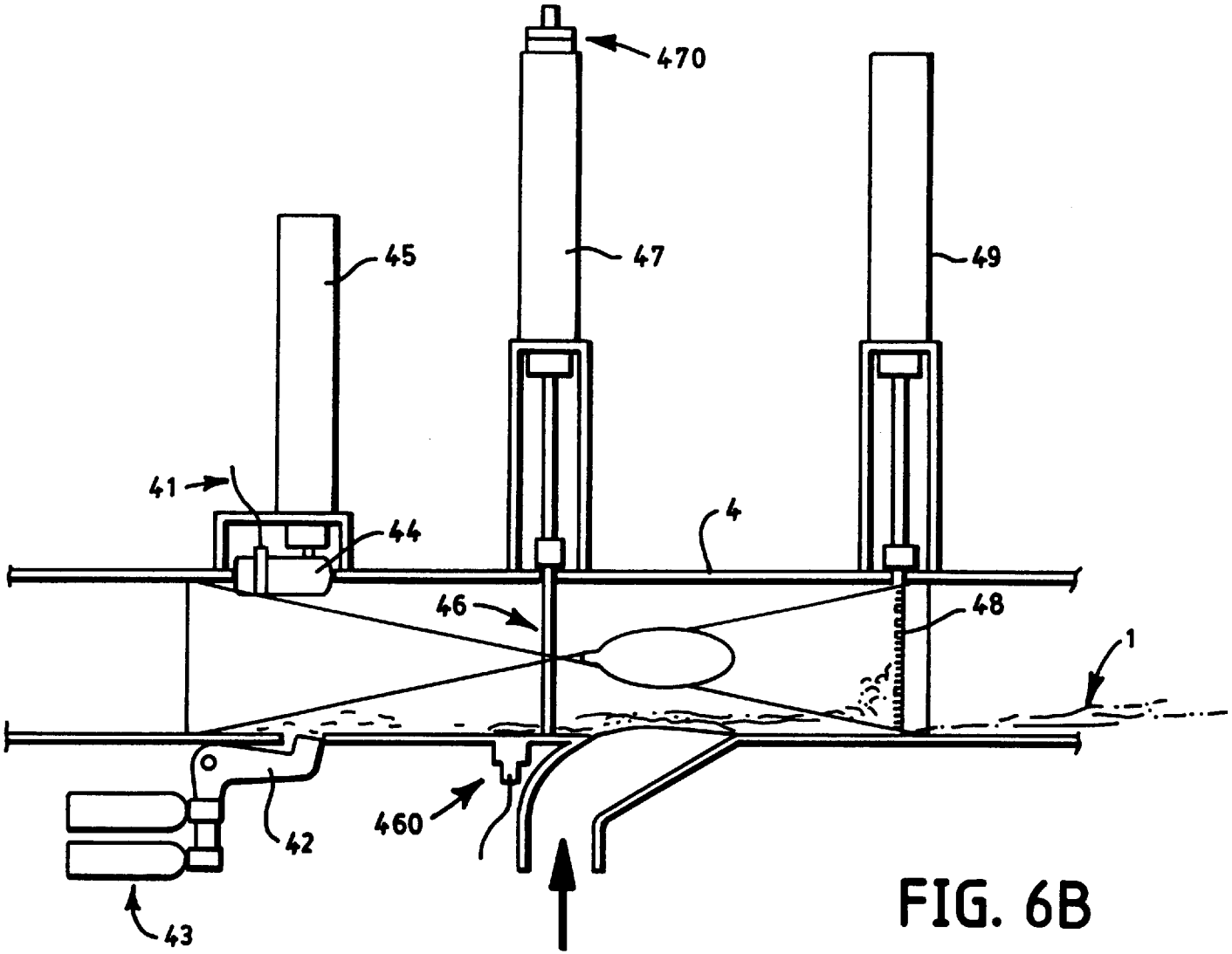
FIG. 6B shows a detail of the apparatus of FIG. 6A.
Figure 7:
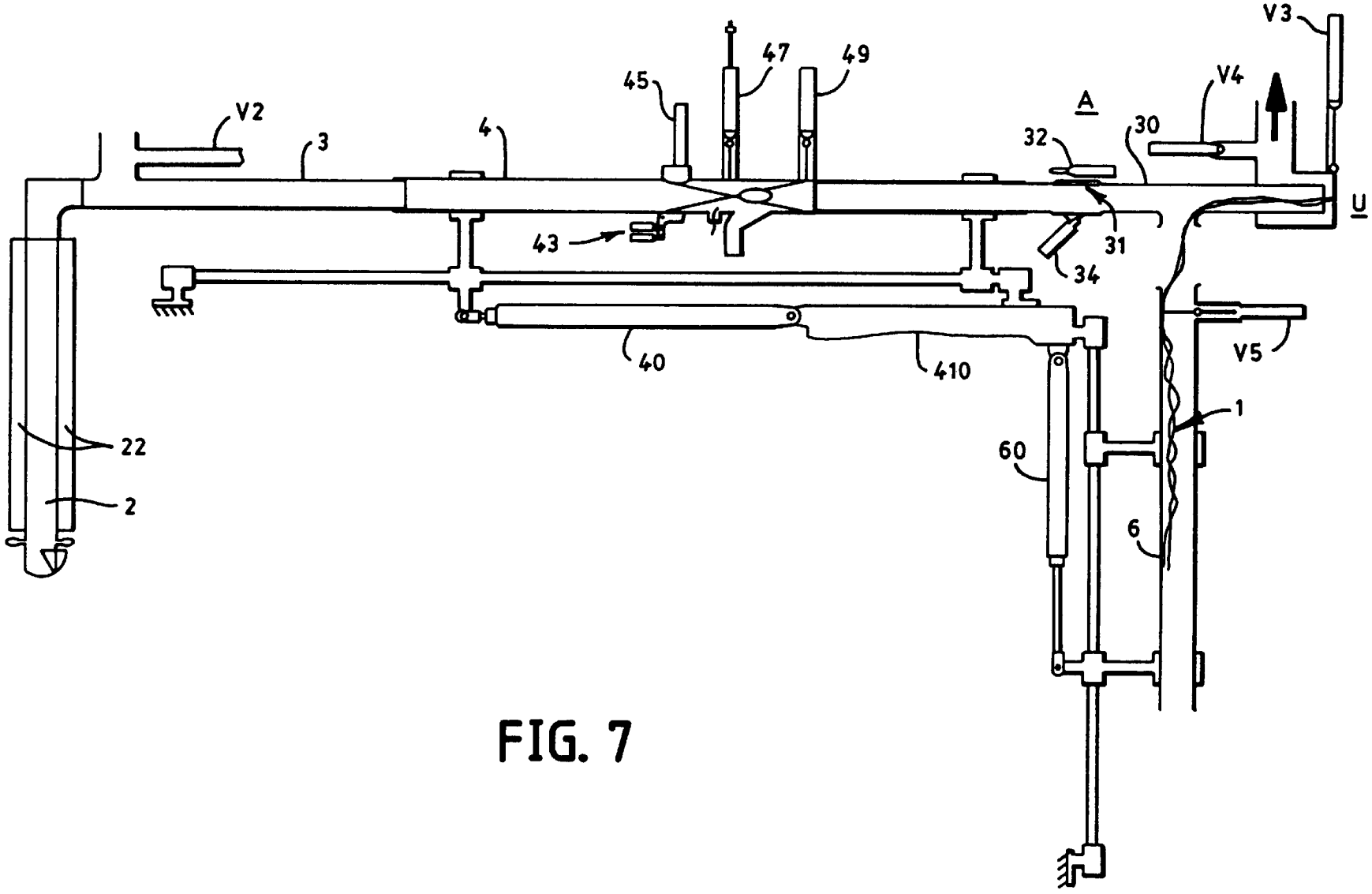
FIG. 7 shows the apparatus of FIG. 6A in a subsequent operating step.

| V2 | V3 | V4 | V5 | V6 | |
|---|---|---|---|---|---|
| OFF | OFF | ON | OFF | OFF | (FIG. 1A) |
| ON | ON | OFF | OFF | OFF | (FIG. 2A) |
| ON | ON | OFF | OFF | OFF | (FIG. 3A) |
| OFF | OFF | ON | OFF | OFF | (FIG. 3D) |
| OFF | OFF | ON | OFF | ON | (FIG. 5A) |
| OFF | OFF | OFF | ON | ON | (FIG. 6A) |
| OFF | OFF | ON | OFF | OFF | (FIG. 7) |

Figure 8:
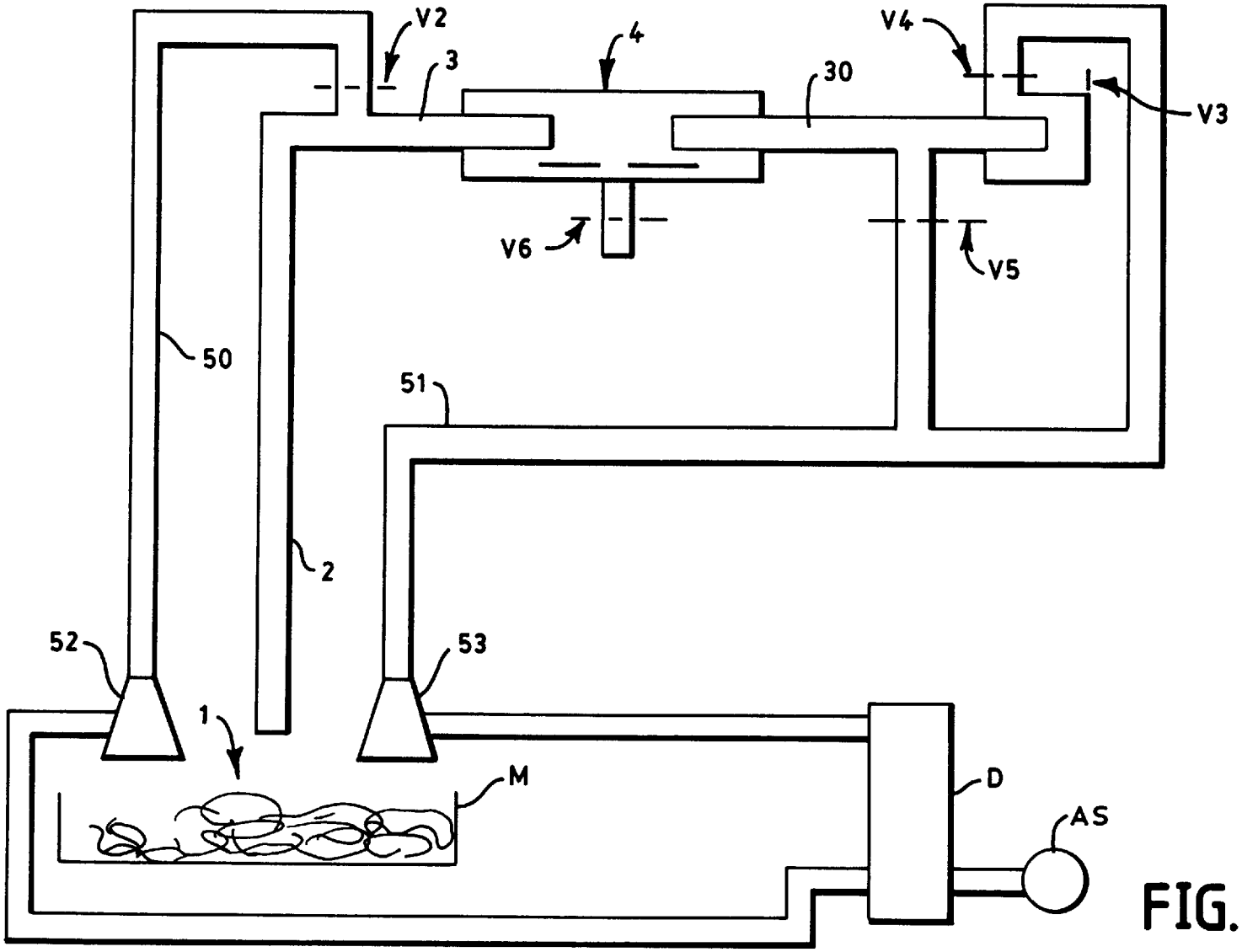
FIG. 8 shows a schematic representation of pneumatic system that can be associated to the apparatus of the preceding figures.
Figure 9:
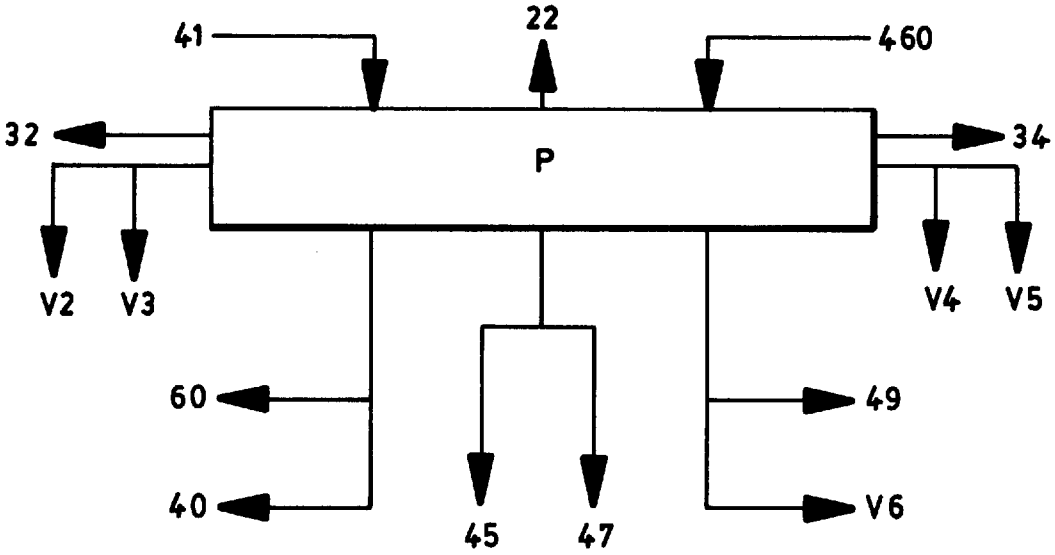
FIG. 9 shows a functional schematic representation of the means for operating the apparatus illustrated in the preceding figures, wherein (P) designates a programmable control unit known per se.

In the circuit illustrated in FIG. 8, the by-pass conduits (50) and (51) derived respectively from conduits (3) and (30) are intended for the recovery of surplus articles (1) , that is, articles moved away from the apparatus and to be brought back to the container (M). The operation of the above described apparatus, reference being made to the articles having ends with different thickness, is as follows.

Figure 3B:
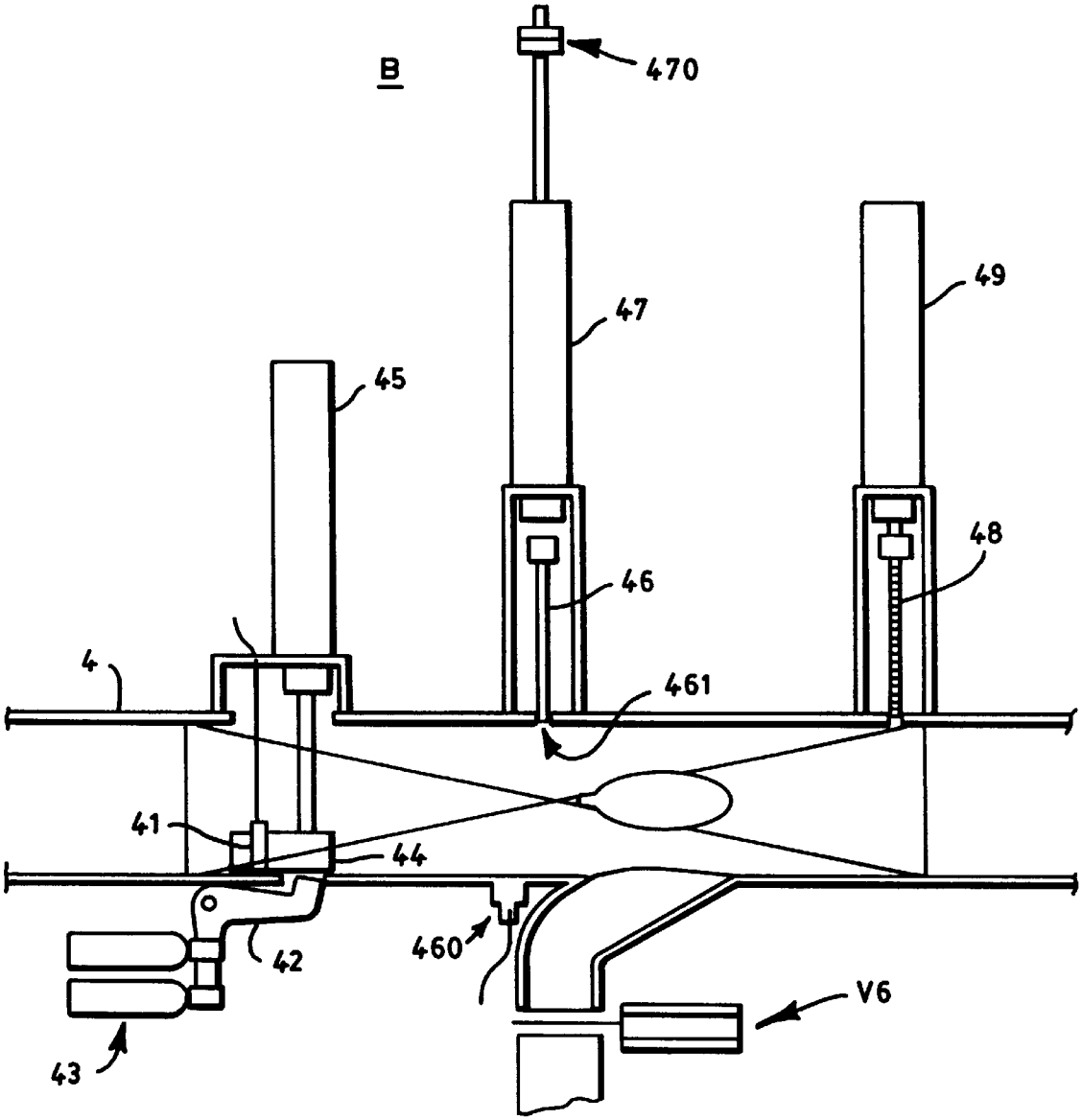
FIG. 3B shows a detail of the apparatus of FIG. 3A.
Figure 3C:
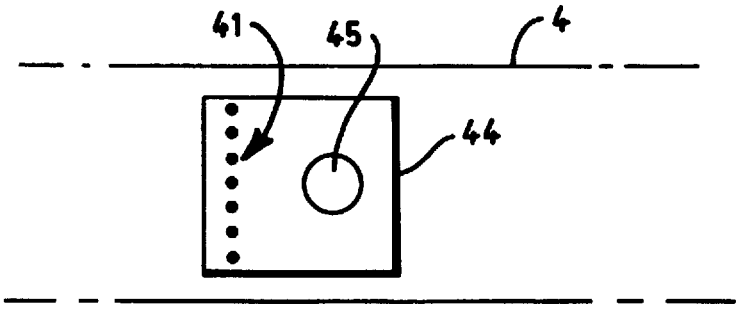
FIG. 3C shows a plan view of the optical sensors and of the buffer associated to the carriage of FIG. 3A.
Figure 4C:
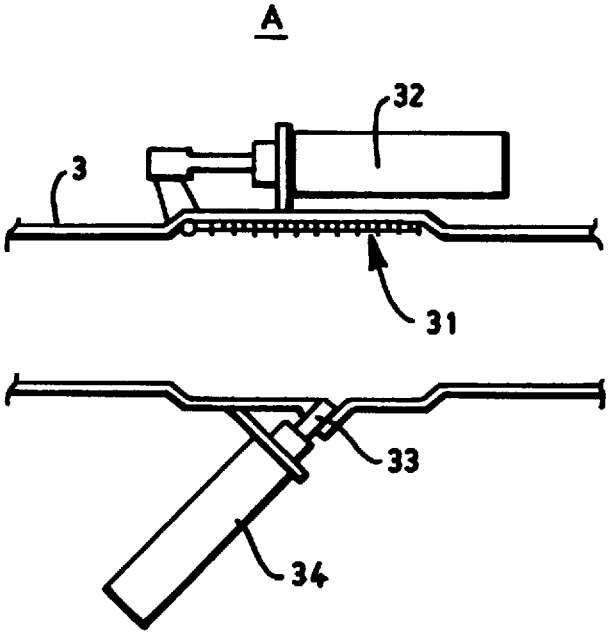
FIGS. 4B and 4C show two deails of the apparatus of FIG. 4A.
Figure 3D:
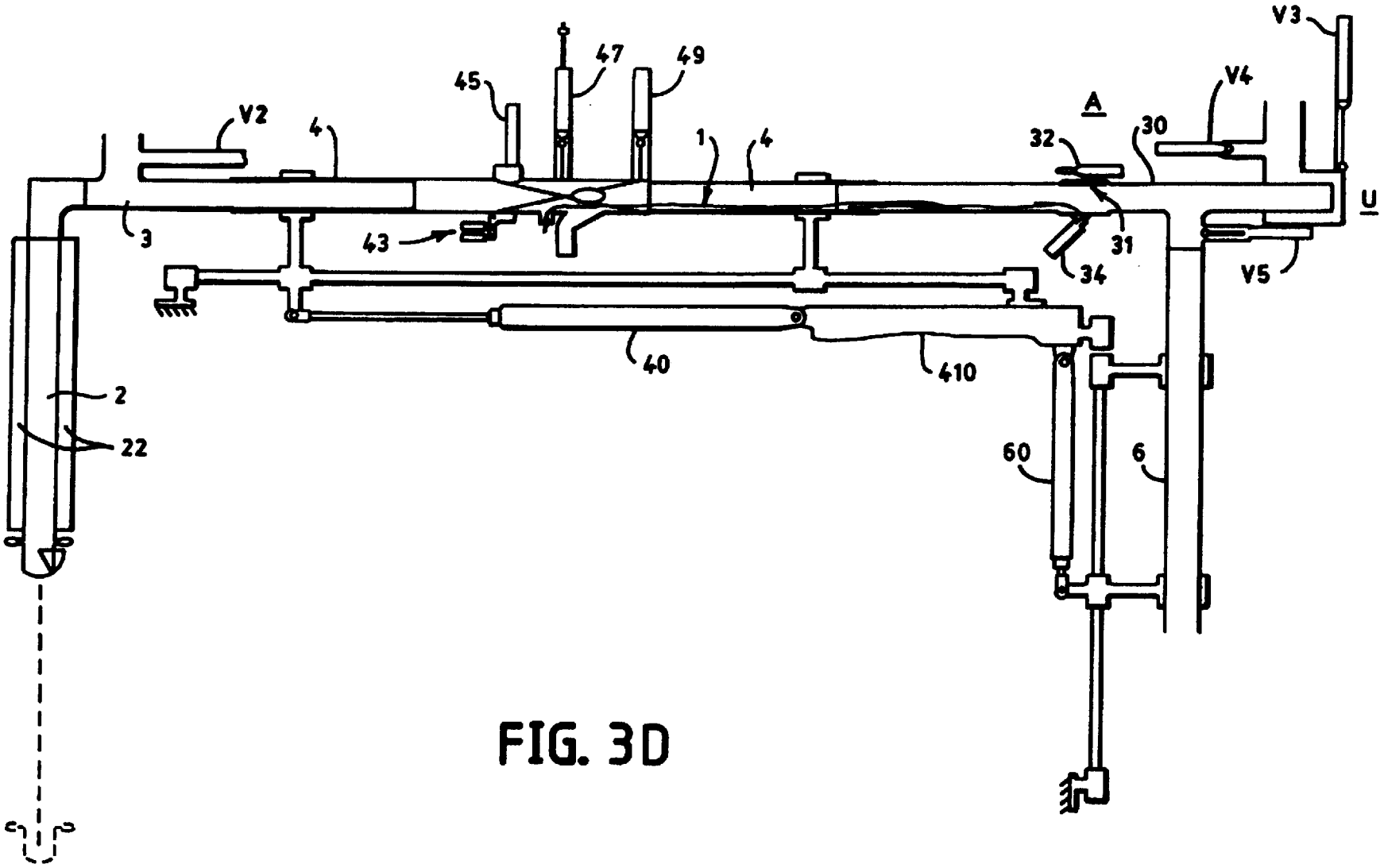
Figure 4A:
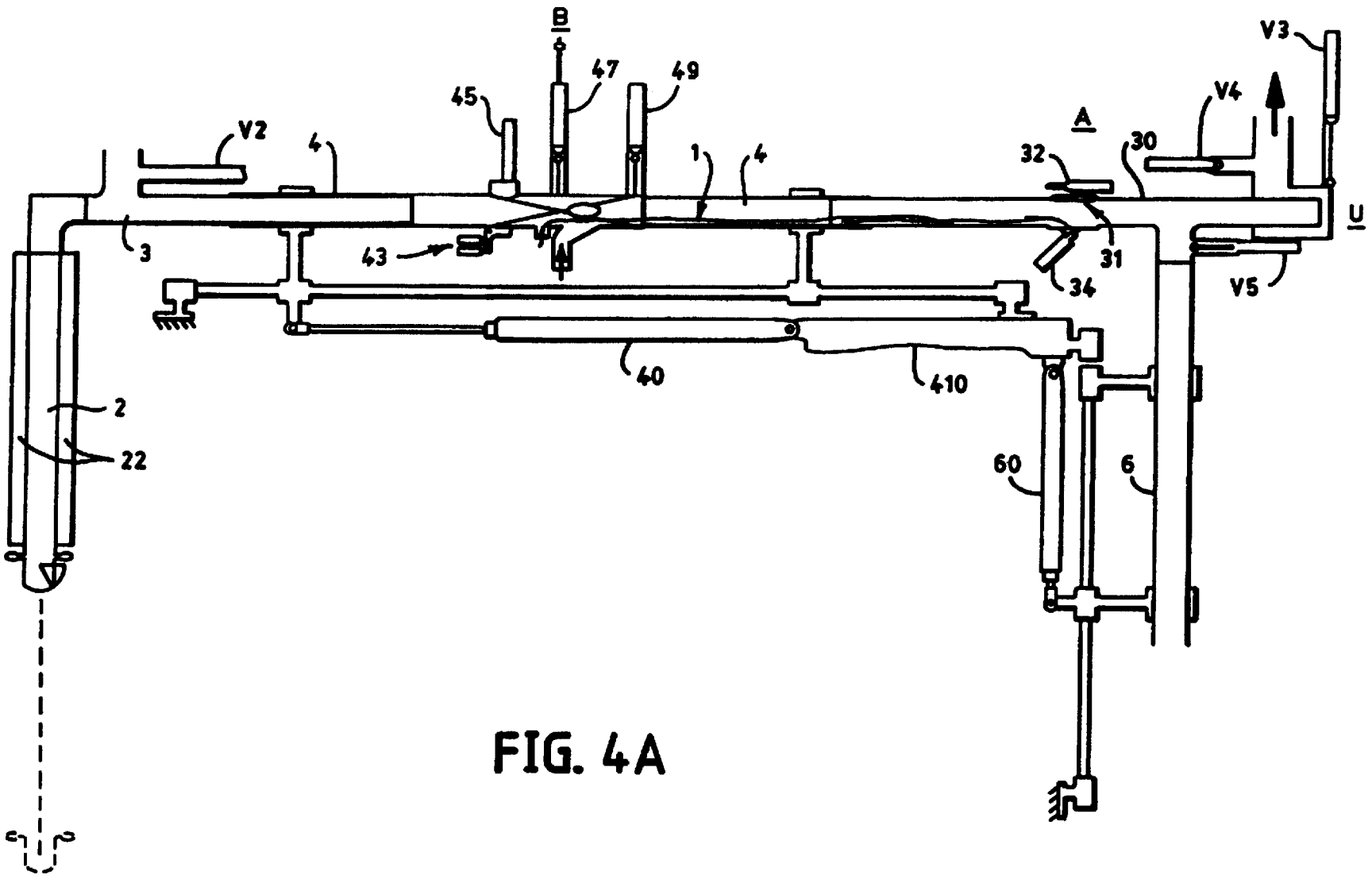
FIG. 4A shows the apparatus of FIG. 1A upon an operating step, subsequent to the one of FIG. 3A.
Figure 4B:
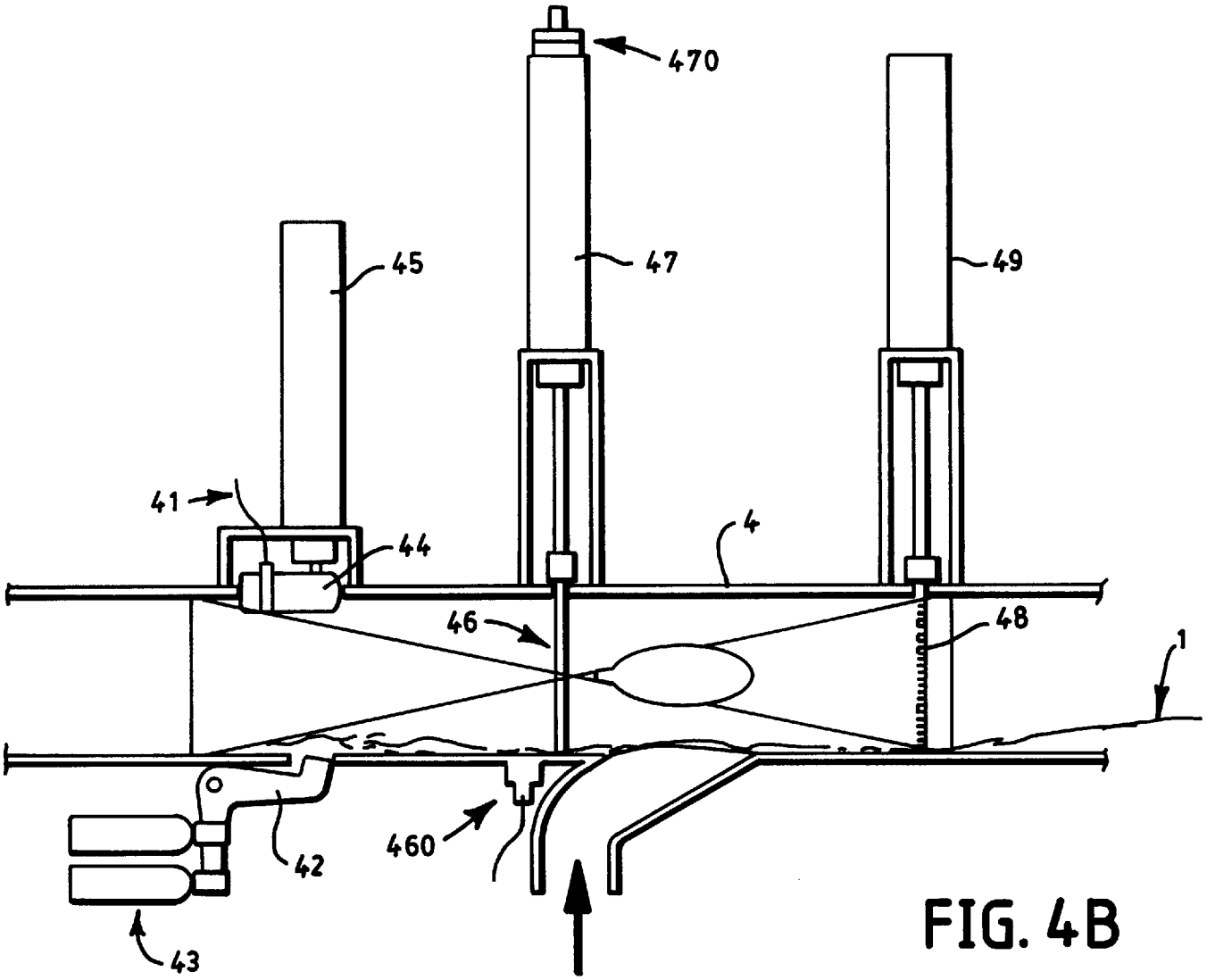

At the beginning of the cycle, the tube (2) is moved by the actuators (22) so as to have its mouth (20) brought in correspondence of the accumulation region of the articles (1) to be treated (FIG. 1A), the respective suction means are activated to operate the removal of at least one article (1), with the valve (23) being disposed in such a condition as to have the mouth (20) opened to the minimum extent, and the articles of the heap (M) adhering to those thus picked up by the tube (2) are detached by means of the compressed air coming out of the nozzle (21). The article of the heap (M) may adhere spontaneously to each other, owing to the proper nature of the material they are made of. In case of stockings, the articles are of knit fabric obtained from yarns of synthetic nature which actually tend to generate such spontaneous adhesion. Accordingly, the valve (23) is disposed in a state that gives rise to the maximum opening of the mouth (20) but, beforehand, the plate (31) of station (A) is disposed in a state corresponding to the closing of the relevant portion of tube (30) (FIG. 2A) so as to cause, in said station (A), the stopping of the article(s) (1) picked by the tube (2). At this point, the actuator (34) is activated to operate the retention of the articles by means of the body (33) (FIG. 2B) which goes into the tube (30). Afterwards, the suction is inverted so as to cause the stretching of the thus retained articles according to the longitudinal axis in common with the set of conduits (3, 4, 30) and the carriage is moved in the direction of arrow F of FIG. 3A to allow for the detection of the article (1) end portion which results further away from said station (A). More specifically, the carriage (4) is moved until any of the sensors (41) will detect the article (1) end or portion further away from the retention point at station (A) Under this condition, the lamina (42) associated to the sensor (41), which has operated the detection of said end or portion of the article, is activated so as to press and thus retain the same end or portion onto the lower surface of the buffer (44), suitably moved towards the article thus interposed therebetween (FIG. 3B). In this way, with the subsequent reversal of the suction, the retraction of the body (33) and the opening of the station (A) by the rotation of plate (31) in a direction opposite to that of closure (FIGS. 4A, 4C), there is obtained the moving away, through the unloading station (U), of the articles being released from the grip of said lamina (42) while ensuring the subsequent treatment of only the article (1) held by said lamina (42) in cooperation with the buffer (44). At this point, the lamina (46) is driven into motion by the actuator (47) and the plate (48) by the actuator (49). Then a command is given to release the article (1) from the grip of the lamina (42) and of the buffer (44). The activation of the lamina (46) gives rise to a necking inside the carriage (4) allowing for the passage of only the thinner portion of the article (1), so that, if the portion of the article previously retained by the lamina (42) and buffer (44) is the one corresponding to the thinner portion, the article will result, by virtue of the persistent suction in the direction of the unloading station (U), with the thicker portion thereof already oriented towards this station (U) of the apparatus (FIG. 5A), that is, ready to be picked up by a device known per se, such as the one disclosed in the IT Patents 1215033, 1215035 and 1213536 and which allows the shapes of the pantyhose-sewing machine to be fed in sequence after going through the conduit (30), with the plate (48) being disposed in a condition allowing the retention of the corresponding portion of the article and guided by the carriage (4) to the exit of station (U). It will be appreciated that the plate (48) is caused to release the thus treated article (1) when this is taken over by said device. If, instead, the portion of the article (1) being retained by the lamina (42) in cooperation with buffer (44), is to the thicker one, as detected by the sensor (460), the article's thinner portion will result on the side of the exit station (U) and the operation will be as follows. First, the suction is activated inside the conduit (6) located between the exit station (U) and the station (A) (FIG. 6A), so as to introduce therein the thinner portion of the article (1). Then, said suction is cut off and the portion of the article inserted in the conduit (6) is retained to prevent it from moving and, afterwards, the suction is activated in the direction of the exit station (U) to release the article from the grip of elements (46) and (48) of the carriage (4). In this way, the thicker portion of the article (1) will result turned towards the exit station (U) as desired. Finally, the article portion first introduced into the tube (6) is released for the exit thereof out of the station (U).

In case the article is a stocking, especially of the type suited for the formation of pantyhose articles, the thinner portion of the article is meant the one in correspondence of the toe, and the thicker portion is meant the one in correspondence of the bodice.

The operation of the above indicate operating steps is achieved by a programmable control unit known per se to those skilled in the industrial automation field and which, accordingly, will not be described herein in further details.

Advantageously, according to the invention, said tube (6) is of telescopic construction and is driven into motion by a corrisponding actuator (60) supported by the stationary part (410) of the apparatus.

The operative position of the lamina (46), that is, the distance of its end (461) from the corresponding inner wall of the carriage (4), is adjustable by screw means (470) which are associated to the rod of the actuator (47) and act as limit stops.

Referring now to FIG. 8, (AS) indicates an aspirator, (D) indicates a distributor and (50) and (51) are two conduits downstream of valves (V2) and (V3) respectively for the recovery of the articles (1) ejected by the apparatus and the return thereof to the container (M). The recovery bells (52, 53) are known per se to those skilled in the art.

The tube (2) is advantageously able to be associated with an optical sensor—not shown for sake of clarity in the figures of the accompanying drawings—located in proximity of the mouth (20) to detect the presence of articles (1) in the container or heap (M) and correspondingly stop and reverse the travel of the actuators (22) after the removal of the articles. In a manner equivalent to that above described, reference being made to the figures of the attached drawings, mechanical means may be provided to perform the above indicated steps of picking up, moving and stretching the articles, such as gripper or track means operating at corresponding fixed or mobile positions of the apparatus. Such operating means may be, for example, of the type disclosed in the above mentioned patents.

As illustrated in FIG. 10, according to a further embodiment of the apparatus, the means (42, 43, 45, 47, 49) of station B are in fixed position. To implement the method according to the invention, rollers (R', R", R"') are provided which are disposed intermediate between the stations (A) and (B) and operated from time to time in pairs (R', R"; R', R'"). More specifically, the vertically lined-up rollers (R', R") are intended to move the article, a reduced portion of which is held at the station (A), towards the station (B), until the whole fabric of the article results between the station (A) and the photocells (41). Under this condition is made to a intervene the element (42) associated to the photocell (41) last uncovered.

Advantageously provided upstream of the station (B) is a photocell (F) which, once it is uncovered by the fabric moving forward to the station (A), operates the slowing down of the article-driving rollers (R', R"), to allow a safer control thereof by photocells (41) of the station (B).

The horizontally lined-up rollers (R', R'") are activated only when the it is necessary to deliver the elastic inside the conduit (6) for a predetermined length and then reverse the aspiration and achieving the output of the article through the exit station (U) with the toe turned forwards. The motion of the rollers (R', R'") may be controlled either by a photocell (FW) located in correspondence of a sight position on conduit (6) or by a timer not shown in the figure.

The roller (R') is mounted so as to be able to move away from the roller (R") in case of any unloading of an article through the conduit (6).

Upstream of station (B) a gate valve (SV) may be provided in order to part the guiding conduit of the articles under treatment and obtain a stand-by region (AT) for the articles to be treated afterwards. Moreover, in correspondence of this stand-by region, a so-called anti-twist device, known per se, may be provided.

The container (1) which holds the articles to be treated is advantageously mounted pivoting about its vertical central axis.

The apparatus according to the present invention may be employed not only for loading the shapes of a pantyhose-sewing or line-closer machine but also for feeding each kind of machine of the textile industry requiring the moving and orientation of tubular articles.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. Method for automatically picking up a tubular article comprising the following operating steps:

picking up at least one article;

moving the thus removed article(s) towards a first stop station downstream of a removal station;

holding, in said stop station, a most forward portion of at least one article;

moving each article in a direction opposite to the one of approach to the stop station, so as to achieve the corresponding stretching of the articles held therein and the moving away of the free ones, that is, not held therein;

detecting the article portion which results further away from said first stopping station and operate the retention thereof at a second station in a position intermediate between the station and the first stopping station;

releasing the end of each article being held in the first stopping station;

moving each article in a direction opposite to that of the preceding stretching, so as to move and unload the articles whose end is free, that is, not retained at said second station and thus ensuring that the subsequent steps will affect one article only;

holding, in case the ends of the articles under treatment have different thickness, one portion of said single article at a preset distance from the end thereof which has been retained in said second station;

releasing also the article end being held at said second station;

assessing, should the ends of the articles be of different thickness, the thickness of the article end held in said second station; and moving the thus treated article towards and as far as a third unloading station, after a reversal of its orientation in case its thicker end is detected in said second station.

2. Method according to claim 1, wherein one or more of the above said steps for picking up, moving and stretching the articles are carried out through corresponding pneumatic suctions performed in a direction according to that of said moving and/or stretching steps.

3. Method according to claim 1, wherein provision is made for carrying out the step of detecting the free end of the article in said second station with the use of optical means.

4. Method according to claim 1, wherein one or more of said first, second and third stations are provided in corresponding fixed or mobile positions.

5. Method according to claim 1, wherein the assessment of the thickness of the article end held in said second station is operated by causing the article to pass through an opening or filter of a width less than the maximum thickness of the same article, in a direction oriented from the second station to the exit station, so as to intercept the article's thicker end in case the latter is held in the second station.

6. Apparatus for picking up and moving tubular articles such as knitted stockings, according to the method of claim 1, comprising:

pneumatic means for picking up at least one article;

pneumatic means for moving the thus removed article(s);

means located in said first stopping station for holding the most forward portion of at least one article;

optical means for detecting the article portion which results further away from said first stopping station and associated buffer means to operate the retention thereof in a second station intermediate between the station for picking up the articles and the first stopping station;

mechanical means for holding one portion of an article at a preset distance from the end thereof retained in said second station;

filter means for assessing the thickness of the article end held in said second station.

7. Apparatus according to claim 6, wherein said means for picking up at least one article comprise a tubular body associated to a suction system and provided with a mouth which can be positioned under control in correspondence of the heap, so as to act on any portion of at least one article.

8. Apparatus according to claim 6, wherein said means for moving the articles comprise two coaxial tubular elements having facing ends and being joined by a tubular carriage mounted for sliding on the walls of said elements and engaged to a relevant actuator to allow same carriage to move along an axis substantially coincident with the one in common with the facing end portions of the tubular elements; said tubular elements being engaged to pneumatic suction means acting on each of them.

9. Apparatus according to claim 6 wherein, said means for stopping each article comprise, in at least one of said elements, a perforated plate located inside at least one said element and hinged at a fixed point to allow for its rotation under the control of a relevant actuator, between a first position for the interception or stopping of the picked-up article(s) and a second position for the free transit thereof.

10. Apparatus according to claim 6 wherein, said means for holding a portion of at least one article in correspondence of said station, comprise a rod-like body engaged to an actuator and whose free end is intended to act, under operating conditions, on the article, in cooperation wither with the plate disposed in intercepting position, or with the surface of an inner wall of the tubular elements said body going through a guide hole formed in the tubular element, and the relevant actuator being fixed in correspondence of a wall of the same element.

11. Apparatus according to claim 6 wherein, said means for detecting the article free end which is further away from said stopping station, with a plurality of optical sensors borne by said carriage and lined up according to an axis substantially orthogonal to the axis of motion of the same carriage; to said optical means being associated means for retaining, at a second station, said end of the article in the position detected by said optical means, by means of a plurality of laminae each of which is associated to a corresponding sensor and engaged to a respective actuator, each lamina being hinged at a fixed point to allow for the rotation thereof, under the control of the respective sensor, by means of the corresponding actuator, and bringing the free end thereof in contact with the article in order to retain it in cooperation with a buffer positioned on the opposite side and engaged to a corresponding actuator, the said laminae with the respective actuators, and the said buffer with the respective actuator being integral with the carriage.

12. Apparatus according to claim 6 further comprising, means for detecting any presence of the thicker portion of the article in proximity of said second station, with a lamina going through a corresponding slit of the carriage, orthogonally to the axis of motion of the latter and downstream of the optical means, and engaged to a corresponding actuator to allow for the positioning, under control, of the respective free end at a preset distance from the corresponding and opposite inner wall of the carriage; such distance being suitably chosen and adjustable so as to allow for the transit of the article portions of smaller thicker and to retain those of greater thickness, the lamina with the respective actuator being integral with the carriage.

13. Apparatus according to claim 6, further comprising means, downstream of said lamina, with a second perforated plate engaged to a corresponding actuator in order to intercept, under control, a corresponding portion of the article.

14. Apparatus according to claim 6 further comprising means for possibly inverting the orientation of the article, with at least one tubular element located downstream of the second station and engaged to pneumatic suction means to allow for the movement of the article thereinside.

15. Apparatus according to claim 7 wherein associated to the mouth of said tube, is a nozzle for blowing compressed air in correspondence of the region in which the articles are picked up so as to detach from those already removed others possibly adhering thereto.

16. Apparatus according to claim 7 wherein said tube is of telescopic type and driven into motion by at least one actuator.

17. Apparatus according to claim 12, wherein associated to said lamina is an optical sensor whose function is to detect any presence of a portion of the article held in the second station.

18. Apparatus according to claim 7 wherein said tube is provided, in correspondence of its mouth, with a valve able to controllably reducing the opening thereof so that, upon the article removal step, said opening will be of minimum extent and thereby affecting the minimum number of articles and, upon the next step, the same opening will be of maximum extent to allow for a fast transit of the article(s) through the tube by virtue of the corresponding suction.

19. Apparatus according to claim 14 wherein said tube is of telescopic construction and is driven into motion by a corresponding actuator supported by the stationary part of the apparatus.

20. Apparatus according to claim 12, wherein the operative position of the lamina, that is, the distance of its end from the corresponding inner wall of the carriage, is adjustable by screw means which are associated to the rod of the actuator and act as limit stops.

21. Apparatus according to claim 6, wherein said means for picking up the articles are provided with at least one optical sensor for the detection thereof.

22. Apparatus according to claim 8 wherein, said means for stopping each article comprise, in at least one of said elements, a perforated plate located inside at least one said element and hinged at a fixed point to allow for its rotation under the control of a relevant actuator, between a first position for the interception or stopping of the picked-up article(s) and a second position for the free transit thereof.

23. Apparatus according to claim 8 wherein, said means for holding a portion of at least one article in correspondence of said station, comprise a rod-like body engaged to an actuator and whose free end is intended to act, under operating conditions, on the article, in cooperation whether with the plate disposed in intercepting position, or with the surface of an inner wall of the tubular element; said body going through a guide hole formed in the tubular element, and the relevant actuator being fixed in correspondence of a wall of the same element.

24. Apparatus according to claim 8 wherein, said means for detecting the article free end which is further away from said stopping station, with a plurality of optical sensors borne by said carriage and lined up according to an axis substantially orthogonal to the axis of motion of the same carriage; to said optical means being associated means for retaining, at a second station, the said end of the article in the position detected by said optical means, by means of a plurality of laminae each of which is associated to a corresponding sensor and engaged to a respective actuator, each lamina being hinged at a fixed point to allow for the rotation thereof, under the control of the respective sensor, by means of the corresponding actuator, and bringing the free end thereof in contact with the article in order to retain it in cooperation with a buffer positioned on the opposite side and engaged to a corresponding actuator, said laminae with the respective actuators, and said buffer with the respective actuator being integral with the carriage.

25. Apparatus according to claim 8 further comprising, means for detecting any presence of the thicker portion of the article in proximity of said second station, with a lamina going through a corresponding slit of the carriage, orthogonally to the axis of motion of the latter and downstream of the optical means, and engaged to a corresponding actuator to allow for the positioning, under control, of the respective free end at a preset distance from the corresponding and opposite inner wall of the carriage; such being suitably chosen and adjustable so as to allow for the transit of the article portions of smaller thickness and to retain those of greater thickness, the lamina with the respective actuator being integral with the carriage.

26. Apparatus according to claim 6, further comprising means, downstream of said lamina, with a second perforated plate engaged to a corresponding actuator in order to intercept, under control, a corresponding portion of the article.

* * * * *